US011401820B1

(12) United States Patent
Rao et al.

(10) Patent No.: US 11,401,820 B1
(45) Date of Patent: Aug. 2, 2022

(54) COOLING STRUCTURE AND METHOD OF TRAILING-EDGE CUTBACK OF TURBINE BLADE, AND TURBINE BLADE

(71) Applicant: Shanghai Jiao Tong University, Shanghai (CN)

(72) Inventors: Yu Rao, Shanghai (CN); Yuyang Liu, Shanghai (CN); Peng Zhang, Shanghai (CN); Shijia Chen, Shanghai (CN)

(73) Assignee: Shanghai Jiao Tong University, Shanghai (CN)

( * ) Notice: Subject to any disclaimer, the term of this patent is extended or adjusted under 35 U.S.C. 154(b) by 0 days.

(21) Appl. No.: 17/579,784

(22) Filed: Jan. 20, 2022

(30) Foreign Application Priority Data

Feb. 3, 2021 (CN) ..... 202110149654.0

(51) Int. Cl.
*F01D 5/18* (2006.01)

(52) U.S. Cl.
CPC ..... *F01D 5/186* (2013.01); *F05D 2220/32* (2013.01); *F05D 2240/30* (2013.01); *F05D 2240/304* (2013.01); *F05D 2260/202* (2013.01); *F05D 2260/22141* (2013.01)

(58) Field of Classification Search
CPC ..... F01D 5/186; F05D 2240/122; F05D 2240/304; F05D 2260/22141; F05D 2260/2214
See application file for complete search history.

(56) References Cited

U.S. PATENT DOCUMENTS

| | | | | |
|---|---|---|---|---|
| 7,575,414 | B2 * | 8/2009 | Lee | F01D 5/187 415/115 |
| 7,766,615 | B2 * | 8/2010 | Spangler | F01D 5/187 416/97 R |
| 9,017,027 | B2 * | 4/2015 | Campbell | F01D 5/187 416/97 R |
| 9,482,100 | B2 * | 11/2016 | Kohli | F01D 5/186 |
| 10,260,354 | B2 * | 4/2019 | Bunker | B22F 10/20 |
| 2006/0099073 | A1 | 5/2006 | Djeridane et al. | |
| 2008/0199317 | A1 * | 8/2008 | Spangler | F01D 5/187 416/95 |
| 2013/0149169 | A1 * | 6/2013 | Campbell | F28F 3/048 415/176 |
| 2014/0219815 | A1 | 8/2014 | Kohli et al. | |
| 2017/0211393 | A1 | 7/2017 | Wong | |
| 2017/0234138 | A1 * | 8/2017 | Bunker | F01D 9/041 415/115 |

FOREIGN PATENT DOCUMENTS

| | | | |
|---|---|---|---|
| CN | 107269319 | A | 10/2017 |
| CN | 110748384 | A | 2/2020 |

* cited by examiner

*Primary Examiner* — Eldon T Brockman

(57) ABSTRACT

A cooling structure on a trailing-edge cutback of a turbine blade, including a plurality of lands, a trailing edge cutback and a dimple group. Adjacent lands are arranged on wall surfaces at two sides of the trailing edge cutback. The wall surfaces are each provided with the dimple group including multiple dimples. An extension direction of at least one dimple forms an inclined angle with the land on one side, and/or an extension direction of at least one dimple forms an inclined angle with the land on the opposite side. The cooling air enters the trailing edge, and after passing through pin fins, then flows over the dimples along the cutback surface to generate a spiral vortex which is guided to the lands on both sides thereof.

9 Claims, 3 Drawing Sheets

COOLING STRUCTURE AND METHOD OF TRAILING-EDGE CUTBACK OF TURBINE BLADE, AND TURBINE BLADE

CROSS-REFERENCE TO RELATED APPLICATIONS

This application claims the benefit of priority from Chinese Patent Application No. 202110149654.0, filed on Feb. 3, 2021. The content of the aforementioned applications, including any intervening amendments thereto, is incorporated herein by reference in its entirety.

TECHNICAL FIELD

This application relates to turbine blade cooling, and more particularly to a cooling structure and method of a trailing-edge cutback for a turbine blade, and a turbine blade.

BACKGROUND

The trailing edge of the turbine blade of the existing aero-engines and gas turbines generally adopts a cutback ejection film-cooling structure. A cooling passage inside the trailing edge of the turbine blade is composed of a pressure side, a suction side and separating lands, where the separating lands are formed by the extension of the pressure side on the trailing edge cutback.

It is troublesome to cool the trailing edge cutback of the turbine blade. Considering that the trailing edge should be thin enough to meet the high aerodynamic performance of the turbine blade, it is challenging to introduce a complex cooling structure in the trailing edge, and a cooling air flow at the trailing edge is limited. In addition, wall surfaces of the trailing edge cutback of the turbine blade will suffer great thermal load under heating of the pressure side and the suction side, such that it is essential to perform thermal protection by means of the film cooling and the convective cooling generated by the cutback jet to extend the service life of the turbine blade.

The cooling air flows into the trailing edge through the blade root and provides the convective cooling inside the trailing edge. After passing through the cooling passage in the trailing edge, the cooling air flows out through air holes of the cutback and generates the film cooling at a surface of the cutback.

Chinese Patent Application Publication No. 105545372 A discloses a turbine blade with a step-shaped slot cooling structure at a pressure side. The cooling structure includes a blade base body, a film slot, a connecting land and a step-shaped surface, where a step-shaped slot film outflow structure is formed by an inner sheet and an outer sheet on a pressure side of the turbine blade and the connecting land, such that the cooling air is allowed to flow out along a tangential direction of the blade surface. Through a uniform and consistent cooling film can be formed on the blade surface in the early stage, the film flow at the cutback surface is still prone to the disturbance brought by the shear flow and vortex, causing an obvious flow separation. As a consequence, the film cooling effect declines accompanied by the temperature rise and ablation at the cutback wall, greatly shortening the service life of the turbine blade. In addition, the introduction of the connecting land at the cutback surface not only brings a larger weight, but also exacerbates the aerodynamic loss of an external main flow, weakening performances of a turbine engine.

Therefore, it is urgently needed to develop a turbine blade with continuously improved cooling effect for the trailing edge to improve the durability and reliability of the turbine engine.

SUMMARY

An object of the present disclosure is to provide a trailing-edge cutback structure and method for a turbine blade and a turbine blade to overcome the defects of the prior art. By arranging a plurality of dimples on the cutback wall, the control of the air flow at the cutback wall surface is intensified, and a damage caused by a shear flow generated by an external main flow to the film flow on the cutback wall is suppressed, improving the thermal protection performance of the film flow.

In a first aspect, this application provides a cooling structure on a trailing-edge cutback of a turbine blade, comprising:

a plurality of lands arranged spaced apart;

a trailing edge cutback; and a dimple group;

wherein adjacent two lands are respectively arranged on wall surfaces at two sides of the trailing edge cutback; the trailing edge cutback is provided between the adjacent two lands; and the wall surfaces of the trailing edge cutback are each provided with the dimple group;

the dimple group comprises a plurality of dimples; an extension direction of at least one of the plurality of dimples forms an inclined angle with a land on one side; and/or an extension direction of at least one of the plurality of dimples forms an inclined angle with another land on an opposite side;

a cooling air enters a trailing edge of the turbine blade, after passing through pin fins, then flows over the dimples along the cutback surface to generate a spiral vortex; and the spiral vortex is guided to lands on two radial sides thereof; and the plurality of dimples are arranged in pairs in a spaced chevron shape, and arranged sequentially on the wall surfaces of the trailing edge cutback.

In some embodiments, two dimples in pairs are arranged closely or staggeredly.

In some embodiments, the plurality of dimples are arranged staggeredly and spaced apart.

In some embodiments, the plurality of dimples are ellipsoidal, elongated, racetrack-shaped or oval.

In some embodiments, the dimple group is arranged in two rows; an intermediate flow passage is arranged between two rows of dimples; and two sides of the intermediate flow passage are provided with a buffer flow passage.

In some embodiments, the plurality of dimples are configured to guide the cooling air to a tail of the plurality of lands from a middle of the trailing edge cutback.

In some embodiments, the plurality of dimples are configured to guide the spiral vortex to edges of the lands on two radial sides of the spiral vortex.

In a second aspect, this application provides a cooling method of a trailing-edge cutback of a turbine blade, comprising:

cooling a trailing edge cutback of the turbine blade by means of the above-mentioned cooling structure.

In a third aspect, this application provides a turbine blade, comprising the above-mentioned cooling structure on the trailing-edge cutback.

Compared to the prior art, the disclosure has the following technical effects.

(1) Regarding the cooling structure provided herein, a plurality of dimples are introduced on the trailing edge cutback, such that the cooling effects of the trailing edge cutback of the turbine blade and the external film cooling effect are enhanced, which facilitates reducing the consumption of the cooling air at the trailing edge, as well as improving the thermal efficiency of the aero-engine and gas turbine.

(2) The plurality of dimples enable the uniform cooling effect of the trailing edge cutback without additional increase in the blade weight of the, promoting the extension of the service life of the turbine blade.

(3) The plurality of dimples are arranged in pairs in a spaced chevron shape or staggeredly spaced apart, such that the intermediate flow passage and the buffer flow passage are formed, where a high-velocity airflow can be generated in the intermediate flow passage to suppress the disturbance of a main flow and shear flow to the film flow on the wall surface of the cutback.

(4) By means of the plurality of dimples, the spiral vortex generated on the wall is guided to the edge of the lands on two radial sides of the spiral vortex, enhancing the cooling effect and thermal protection effect of the lands.

BRIEF DESCRIPTION OF THE DRAWINGS

The objects, features and advantages of the present disclosure will become apparent below with reference to the embodiments and accompanying drawings.

Figure 1:
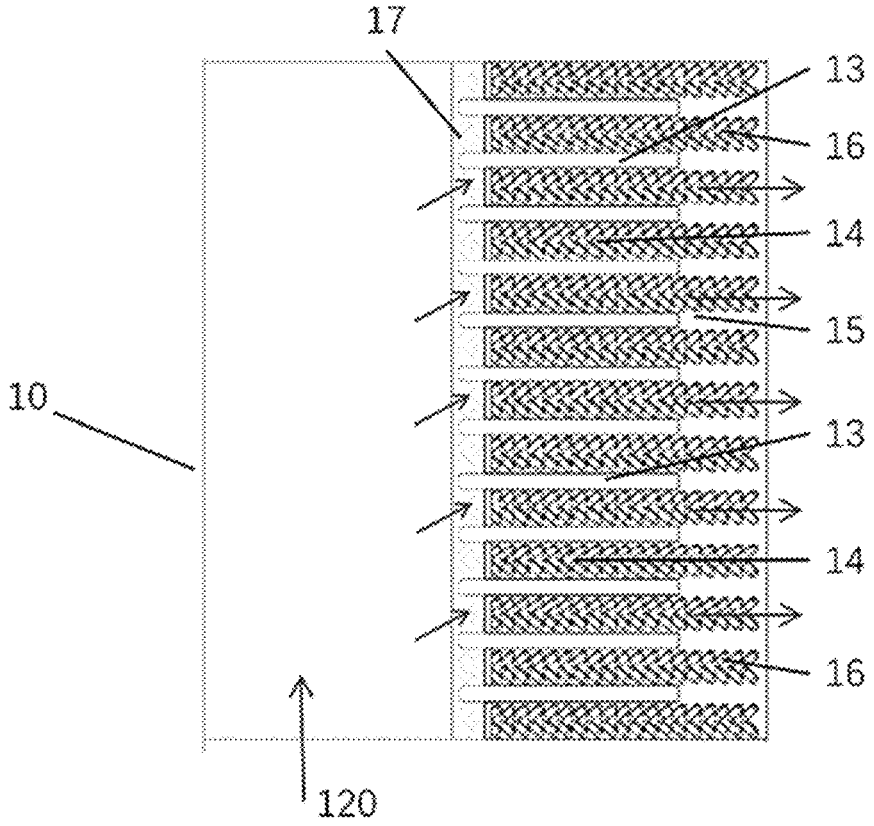
FIG. 1 schematically depicts an overall structure of a cooling structure on a trailing-edge cutback of a turbine blade according to an embodiment of the present disclosure.

In the drawings, 10, trailing edge; 13, land; 131, land edge; 14, trailing edge cutback; 15, land tail; 16, dimple; 17, cutback entrance; 100, cooling air flow direction; 101, backflow vortex; 102, film outflow; 110, spiral vortex; 112, buffer flow passage; 115, intermediate flow passage; 120, cooling air; and 20, pin fin.

DETAILED DESCRIPTION OF EMBODIMENTS

The present disclosure will be described below in detail with reference to the embodiments. It is apparent that the embodiments are merely illustrative and are not intended to limit the disclosure. It should be noted that any variations and improvements made by those of ordinary skilled in the art without departing from the spirit of the disclosure shall fall within the scope of the disclosure defined by the appended claims.

Figure 4:
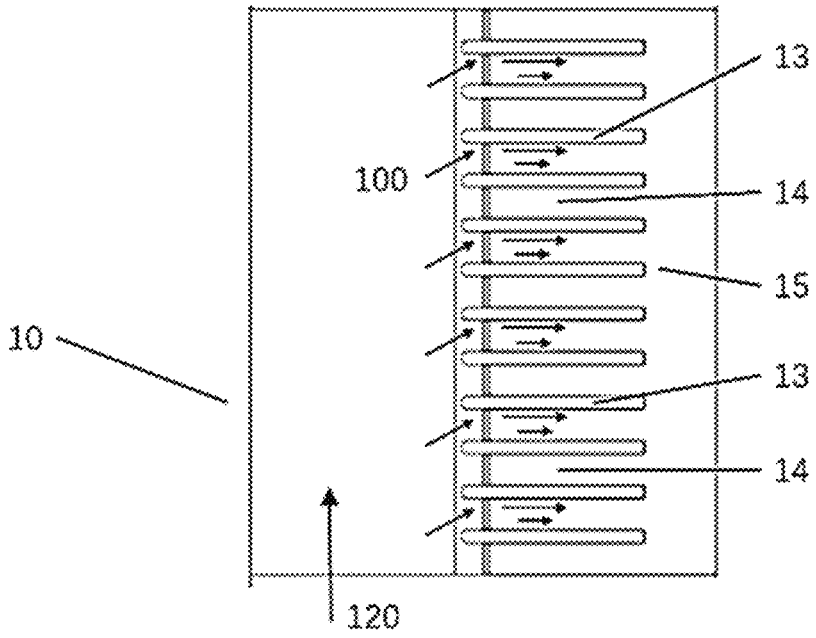
FIG. 4 structurally depicts a trailing edge of an ordinary turbine blade.

Regarding an ordinary trailing edge structure (shown in FIG. 4), a cooling air 120 enters a trailing edge 10 from a blade root, then flows out from a trailing edge cutback 14 along a cooling air flow direction 100, such that a film cooling is generated at wall surfaces of the trailing edge cutback 14. However, this air flow manner cannot generate a uniform film outflow 102, thus leading to a poor film cooling effectiveness on the wall surfaces of the trailing edge cutback 14.

Figure 5:
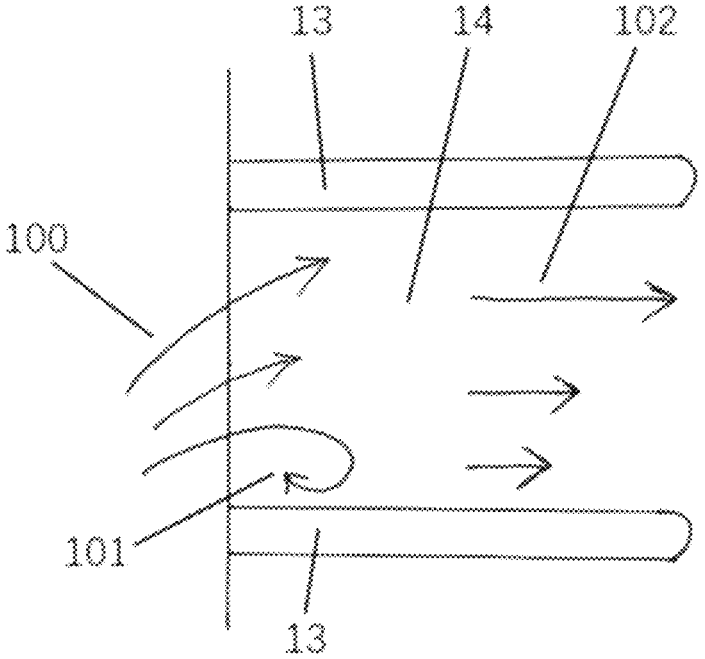
FIG. 5 schematically depicts an air flow direction in the trailing edge of the ordinary turbine blade.

The above-mentioned problems are caused by that the cooling air 120 radially enters the trailing edge 10 through the blade root along while axially flow out of the cutback (as shown in FIG. 5). For a rotating turbine blade, the cooling air outflow from the cutback tends to gather toward a radial side due to the centrifugal force, which makes the cooling air 120 flow on the wall surfaces of the trailing edge cutback 14 uneven and leads to the generation of a backflow vortex 101, further weakening the uniformity of the film cooling. Moreover, a film flow on the wall surfaces of the trailing edge cutback 14 is susceptible to an external shear flow, which weakens the film cooling effectiveness of the trailing edge cutback 14. The high-temperature and high-speed hot gas outside the turbine blade generates a strong shear flow on the wall surfaces of the trailing edge cutback 14, resulting in an unsteady vortex. The unsteady vortex attaches to the cutback surface and has an interaction with the cooling air flow. The film flow is prone to disturbance of the shear flow and vortex, which leads to an elevated temperature and causes an ablation at the wall surfaces of the trailing edge cutback 14, shortening the service life of the turbine blade.

Figure 2:
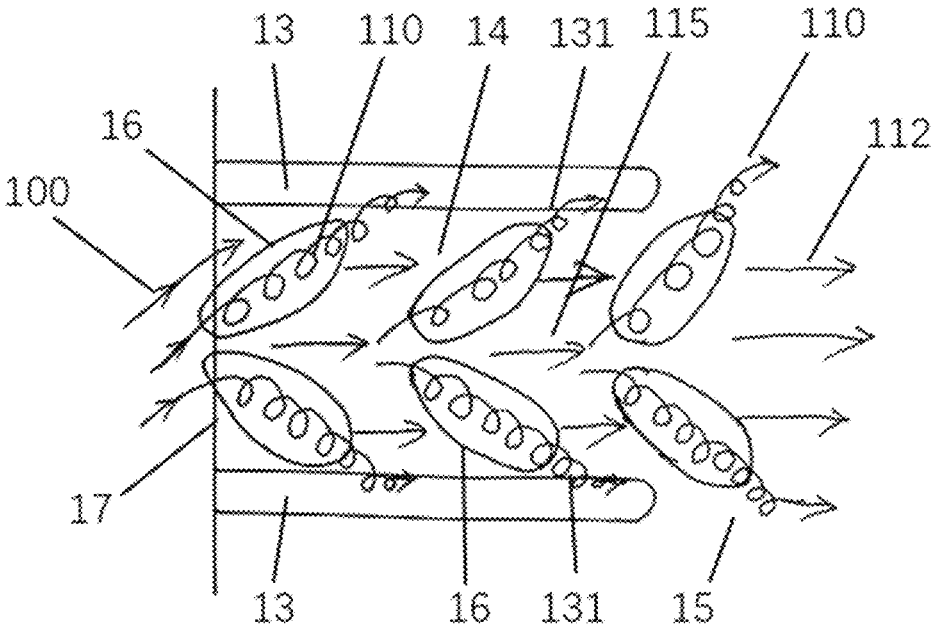
FIG. 2 schematically depicts a flow direction of a cooling air in the cooling structure according to an embodiment of the present disclosure.
Figure 3:
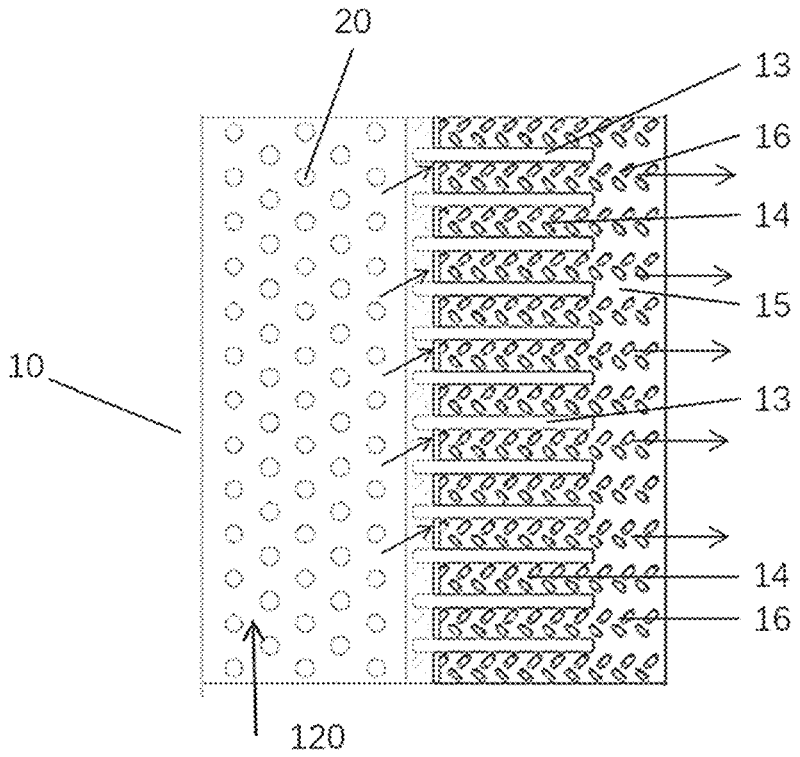
FIG. 3 schematically depicts an overall structure of a cooling structure on a trailing-edge cutback according to another embodiment of the present disclosure.

As shown in FIGS. 1-3, this application provides a cooling structure on the trailing-edge cutback of a turbine blade, including multiple lands 13 arranged spaced apart, a land edge 131, a trailing edge cutback 14, a land tail 15, multiple dimples 16, a cutback entrance 17, a buffer flow passage 112 and an intermediate flow passage 115.

Adjacent two lands 13 are respectively arranged on wall surfaces at two sides of the trailing edge cutback 14. The trailing edge cutback 14 is provided between the adjacent two lands 13. The wall surfaces of the trailing edge cutback 14 are each provided with a dimple group. The dimple group includes multiple dimples 16. An extension direction of at least one of the dimples 16 forms an inclined angle with a land 13 on one side, and/or an extension direction of at least one of the dimples forms an inclined angle with another land 13 on the opposite side.

A cooling air 120 enters a trailing edge of the turbine blade 10, and after passing through pin fins 20, then flows over the dimples 16 along the cutback surface 14 from the flow direction 100 to generate a spiral vortex 110. The spiral vortex 110 is guided to the lands 13 on two radial sides thereof.

In an embodiment, as shown in FIG. 2, the dimple group is arranged in two rows. The intermediate flow passage 115 is arranged between two rows of dimples. Two sides of the intermediate flow passage 115 are provided with a buffer flow passage 112. The cooling air 120 flowing out from the buffer flow passage 112 guides a cooling fluid to two sides of the trailing edge cutback 14 to even a flow distribution of the cooling fluid on the wall surfaces of the trailing edge cutback 14 for a preferable cooling effect of the trailing edge cutback. The cooling air 120 flowing out from the intermediate flow passage 115 will be accelerated to obtain a greater outflow kinetic energy to avoid a disturbance brought by a main flow, so as to obtain a preferable film cooling.

In an embodiment, a spiral vortex 110 is generated on the wall surfaces of the trailing edge cutback 14 due to the dimples 16. The dimples 16 are configured to guide the spiral vortex 110 to land edges 131 on two radial sides of the spiral vortex 110, such that the cooling effect and thermal protection of the lands 13 are enhanced. Such structure is mainly to solve the existing problems that the cooling air at the land edges 131 is prone to flow instability to generate a complex vortex and a high turbulent kinetic energy flow, which leads to the occurrence of a high heat transfer zone and a high temperature zone and destroys the film flow on the wall surfaces of the trailing edge cutback 14, reducing the film cooling performance and shortening the service life of the blade trailing edge.

In addition, in the conventional blade trailing edge, the lands 13 have a thinned downstream and the land tail 15 has a lower film cooling efficiency, because the cooling air flowing out from the trailing edge cutback 14 moves in the flow direction and constantly diffuses to the main flow thereupon, so the cooling air is difficult to diffuse to a tail area of the lands 13. The dimples 16 are configured to guide the cooling air to the land tail 15 from a middle of the trailing edge cutback 14, improving the film coverage and the film cooling effect of the trailing edge 10.

By means of the dimples 16, the control of an airflow on the wall surfaces of the trailing edge cutback 14 is enhanced, and the disturbance of the shear flow generated by the main flow to the film flow on the wall surface of the trailing edge cutback is suppressed, improving the thermal protection effect of the film flow.

As shown in FIG. 1, in an embodiment, the dimples 16 are arranged in pairs in a spaced chevron shape, and arranged sequentially on the wall surfaces of the trailing edge cutback 14. Two dimples 16 in pairs are arranged closely or staggeredly and point to the adjacent lands 13 on two sides, respectively.

As shown in FIG. 3, in an embodiment, the dimples 16 are staggeredly arranged and spaced apart.

In an embodiment, the dimples 16 are ellipsoidal, elongated, racetrack-shaped or oval.

As used herein, terms "up", "down", "front", "back", "left", "right", "vertical", "horizontal", "top", "bottom", "inner" and "outer" refer to orientational or positional relationship shown in the drawings, which are merely for better description of the present disclosure instead of indicating or implying that the device or element referred to must have a specific orientation, be constructed and operated in a specific orientation. Therefore, these terms should not be construed as a limitation to the present disclosure.

Described above are only some embodiments of the present disclosure, which are not intended to limit the disclosure. Any variations and modifications made by those of ordinary skilled in the art without departing from the spirit of the disclosure should fall within the scope of the disclosure defined by the appended claims.

What is claimed is:

1. A cooling structure on a trailing-edge cutback of a turbine blade, comprising:

a plurality of lands arranged spaced apart;

a trailing edge cutback; and a dimple group;

wherein adjacent two lands are respectively arranged on wall surfaces at two sides of the trailing edge cutback; the trailing edge cutback is provided between the adjacent two lands; and the wall surfaces of the trailing edge cutback are each provided with the dimple group;

the dimple group comprises a plurality of dimples; an extension direction of at least one of the plurality of dimples forms an inclined angle with a land on one side; and/or an extension direction of at least one of the plurality of dimples forms an inclined angle with another land on an opposite side;

a cooling air enters a trailing edge of the turbine blade, after passing through pin fins, then flows over the dimples along a surface of the trailing edge cutback to generate a spiral vortex; and the spiral vortex is guided to lands on two radial sides thereof; and the plurality of dimples are arranged in pairs in a spaced chevron shape, and arranged sequentially on the wall surfaces of the trailing edge cutback.

2. The cooling structure of claim 1, wherein two dimples in pairs are arranged closely or spaced apart.

3. The cooling structure of claim 1, wherein the plurality of dimples are arranged staggeredly and spaced apart.

4. The cooling structure of claim 1, wherein the plurality of dimples are ellipsoidal, elongated, racetrack-shaped or oval.

5. The cooling structure of claim 1, wherein the dimple group is arranged in two rows; an intermediate flow passage is arranged between two rows of dimples; and two sides of the intermediate flow passage are provided with a buffer flow passage.

6. The cooling structure of claim 1, wherein the plurality of dimples are configured to guide the cooling air to a tail of the plurality of lands from a middle of the trailing edge cutback.

7. The cooling structure of claim 1, wherein the plurality of dimples are configured to guide the spiral vortex to edges of the lands on two radial sides of the spiral vortex.

8. A cooling method of a trailing-edge cutback of a turbine blade, comprising:

cooling a trailing edge cutback of the turbine blade by means of the cooling structure of claim 1.

9. A turbine blade, comprising:

the cooling structure of claim 1.

* * * * *